US010292890B2

(12) United States Patent
DeVliegar et al.

(10) Patent No.: US 10,292,890 B2
(45) Date of Patent: May 21, 2019

(54) WEARABLE THORAX PERCUSSION DEVICE

(71) Applicant: Hill-Rom Services Pte. Ltd., Singapore (SG)

(72) Inventors: Marten Jan DeVliegar, Taber (CA); Mark Sasha Drlik, Victoria (CA); Ryan David Lee, Victoria (CA)

(73) Assignee: HILL-ROM SERVICES PTE. LTD., Singapore (SG)

( * ) Notice: Subject to any disclaimer, the term of this patent is extended or adjusted under 35 U.S.C. 154(b) by 224 days.

(21) Appl. No.: 15/277,448

(22) Filed: Sep. 27, 2016

(65) Prior Publication Data

US 2017/0035637 A1 Feb. 9, 2017

Related U.S. Application Data

(63) Continuation of application No. 13/930,586, filed on Jun. 28, 2013, now Pat. No. 9,549,869, which is a (Continued)

(51) Int. Cl.

| | |
|---|---|
| ***A61H 23/02*** | (2006.01) |
| ***A61H 1/00*** | (2006.01) |
| ***A61H 23/00*** | (2006.01) |

(52) U.S. Cl.

CPC ..... *A61H 1/008* (2013.01); *A61H 23/006* (2013.01); *A61H 23/02* (2013.01); *A61H 23/0218* (2013.01); *A61H 2201/165* (2013.01); *A61H 2201/1619* (2013.01); *A61H 2201/1697* (2013.01); *A61H 2201/50* (2013.01); *A61H 2205/084* (2013.01)

(58) Field of Classification Search

CPC ..... A61H 1/008; A61H 23/006; A61H 23/02; A61H 23/0218; A61H 2205/084; A61H 2201/165

See application file for complete search history.

(56) References Cited

U.S. PATENT DOCUMENTS

| | | | |
|---|---|---|---|
| 1,646,590 | A | 10/1927 | Mildenberg |
| 2,486,667 | A | 11/1949 | Meister |

(Continued)

FOREIGN PATENT DOCUMENTS

| | | |
|---|---|---|
| CA | 256723 | 8/2011 |
| GB | 1136896 | 12/1968 |

(Continued)

OTHER PUBLICATIONS

The "VibraVest" by OxyCare GmbH, VibraVest_engl_web.pdf, Nov. 23, 2011 (3 pages).

(Continued)

*Primary Examiner* — Timothy A Stanis

(74) *Attorney, Agent, or Firm* — Barnes & Thornburg LLP

(57) ABSTRACT

A wearable thorax percussion device for dislodging mucous buildup in the airways of a human patient, the device comprising frame elements and electromechanical actuators retained by the frame elements to intermittently percuss the thorax, and an electronic controller and power source for generating and modulating an electrical signal to energize the actuator. The frame elements may be interconnected by a garment, or fasteners and elastic or adjustable strapping.

18 Claims, 9 Drawing Sheets

Related U.S. Application Data continuation-in-part of application No. 13/538,716, filed on Jun. 29, 2012, now Pat. No. 9,744,097.

(56) References Cited

U.S. PATENT DOCUMENTS

| | | | | |
|---|---|---|---|---|
| 3,053,250 | A | 9/1962 | Stubbs | |
| 3,291,123 | A | 12/1966 | Terauchi | |
| 3,310,050 | A | 3/1967 | Goldfarb | |
| 3,460,531 | A | 8/1969 | Gardner | |
| 3,802,417 | A | 4/1974 | Lang | |
| 3,955,563 | A | 5/1976 | Maione | |
| 4,069,816 | A | 1/1978 | Yamamura et al. | |
| 4,079,733 | A | 3/1978 | Denton et al. | |
| 4,098,266 | A | 7/1978 | Muchisky et al. | |
| 4,102,334 | A | 7/1978 | Muchisky | |
| 4,216,766 | A | 8/1980 | Duykers et al. | |
| 4,387,708 | A | 6/1983 | Davis | |
| 4,397,306 | A | 8/1983 | Weisfeldt et al. | |
| 4,453,538 | A | 6/1984 | Whitney | |
| 4,508,107 | A | 4/1985 | Strom et al. | |
| 4,512,339 | A | 4/1985 | McShirley | |
| 4,530,349 | A * | 7/1985 | Metzger | A61H 23/06 128/897 |
| 4,624,244 | A | 11/1986 | Taheri | |
| 4,697,580 | A | 10/1987 | Terauchi | |
| 4,838,263 | A | 6/1989 | Warwick et al. | |
| 4,887,594 | A | 12/1989 | Siegel | |
| 4,977,889 | A | 12/1990 | Budd | |
| 5,018,517 | A | 5/1991 | Liardet | |
| 5,056,505 | A | 10/1991 | Warwick et al. | |
| 5,167,226 | A | 12/1992 | Laroche et al. | |
| 5,181,504 | A | 1/1993 | Ono et al. | |
| 5,235,967 | A * | 8/1993 | Arbisi | A61H 23/0218 601/101 |
| 5,261,394 | A | 11/1993 | Mulligan et al. | |
| 5,334,131 | A | 8/1994 | Omandam et al. | |
| 5,451,190 | A | 9/1995 | Liardet | |
| 5,453,081 | A | 9/1995 | Hansen | |
| 5,455,159 | A | 10/1995 | Mulshine et al. | |
| 5,496,262 | A | 3/1996 | Johnson, Jr. et al. | |
| 5,569,170 | A | 10/1996 | Hansen | |
| 5,716,131 | A | 2/1998 | Breeding | |
| 5,738,637 | A | 4/1998 | Kelly et al. | |
| 5,769,797 | A | 6/1998 | Van Brunt et al. | |
| 5,769,800 | A | 6/1998 | Gelfand et al. | |
| 5,891,062 | A | 4/1999 | Schock et al. | |
| 6,022,328 | A | 2/2000 | Hailey | |
| 6,036,662 | A | 3/2000 | Van Brunt et al. | |
| 6,098,222 | A | 8/2000 | Hand et al. | |
| 6,174,295 | B1 | 1/2001 | Cantrell et al. | |
| 6,176,235 | B1 | 1/2001 | Benarrouch et al. | |
| 6,193,678 | B1 | 1/2001 | Brannon | |
| 6,190,337 | B1 | 2/2001 | Nedwell | |
| 6,193,677 | B1 | 2/2001 | Cady | |
| 6,254,556 | B1 | 7/2001 | Hansen et al. | |
| 6,290,660 | B1 | 9/2001 | Epps et al. | |
| 6,352,518 | B1 | 3/2002 | nee Wolf | |
| D456,591 | S | 5/2002 | Hansen | |
| D461,897 | S | 8/2002 | Hansen et al. | |
| 6,478,755 | B2 | 11/2002 | Young | |
| D469,876 | S | 2/2003 | Hansen et al. | |
| 6,547,749 | B2 | 4/2003 | Hansen | |
| D478,989 | S | 8/2003 | Hansen et al. | |
| 6,676,614 | B1 | 1/2004 | Hansen et al. | |
| 6,702,769 | B1 | 3/2004 | Fowler-Hawkins | |
| 6,736,785 | B1 | 5/2004 | Van Brunt | |
| 6,958,047 | B2 | 10/2005 | DeVlieger | |
| 6,984,214 | B2 | 1/2006 | Fowler-Hawkins | |
| 7,074,200 | B1 | 7/2006 | Lewis | |
| 7,128,811 | B2 | 10/2006 | Watanabe | |
| D531,728 | S | 11/2006 | Helgeson | |
| 7,207,953 | B1 | 4/2007 | Goicaj | |
| 7,232,417 | B2 | 6/2007 | Plante | |
| D547,718 | S | 7/2007 | Helgeson et al. | |
| 7,278,978 | B1 | 10/2007 | Hansen et al. | |
| 7,297,126 | B2 | 11/2007 | Kries | |
| 7,343,916 | B2 | 3/2008 | Biondo et al. | |
| 7,374,500 | B2 | 5/2008 | Engdahl | |
| 7,416,536 | B2 | 8/2008 | DeVlieger | |
| 7,445,607 | B2 | 11/2008 | Plante | |
| D585,991 | S | 2/2009 | Helgeson et al. | |
| 7,537,575 | B2 | 5/2009 | Hansen et al. | |
| 7,597,670 | B2 | 10/2009 | Warwick et al. | |
| 7,618,384 | B2 | 11/2009 | Nardi et al. | |
| 7,713,219 | B2 | 5/2010 | Helgeson et al. | |
| 7,736,324 | B1 | 6/2010 | Helgeson | |
| 7,762,967 | B2 | 7/2010 | Warwick et al. | |
| 7,785,280 | B2 | 8/2010 | Kivisto | |
| 7,927,293 | B1 | 4/2011 | Ignagni et al. | |
| 7,931,607 | B2 | 4/2011 | Biondo et al. | |
| D639,954 | S | 6/2011 | Helgeson et al. | |
| 7,981,066 | B2 | 7/2011 | Lewis | |
| 8,108,957 | B2 | 2/2012 | Richards et al. | |
| 8,192,381 | B2 | 6/2012 | Nozzarella | |
| 8,197,428 | B2 | 6/2012 | Helgeson et al. | |
| 8,202,237 | B2 | 6/2012 | Helgeson et al. | |
| 8,241,233 | B2 | 8/2012 | Litton et al. | |
| 8,257,288 | B2 | 9/2012 | Hansen et al. | |
| 8,273,039 | B1 | 9/2012 | Ignagni | |
| 8,460,223 | B2 | 6/2013 | Huster et al. | |
| 8,584,279 | B2 | 11/2013 | Richards et al. | |
| D697,197 | S | 1/2014 | Hansen et al. | |
| 8,734,370 | B1 | 5/2014 | Ignagni | |
| 8,777,880 | B2 | 7/2014 | Davis et al. | |
| 8,790,285 | B2 | 7/2014 | Bisera et al. | |
| 8,801,643 | B2 | 8/2014 | Deshpande et al. | |
| 2002/0014235 | A1 | 2/2002 | Rogers et al. | |
| 2002/0016560 | A1 | 2/2002 | Hansen | |
| 2002/0111571 | A1 | 8/2002 | Warwick et al. | |
| 2002/0195144 | A1 | 12/2002 | Hand et al. | |
| 2004/0069304 | A1 | 4/2004 | Jam | |
| 2004/0097842 | A1 | 5/2004 | Van Brunt et al. | |
| 2004/0097843 | A1 | 5/2004 | Van Brunt et al. | |
| 2004/0097844 | A1 | 5/2004 | Van Brunt et al. | |
| 2004/0097845 | A1 | 5/2004 | Van Brunt | |
| 2004/0097846 | A1 | 5/2004 | Van Brunt et al. | |
| 2004/0097847 | A1 | 5/2004 | Van Brunt et al. | |
| 2004/0097849 | A1 | 5/2004 | Van Brunt | |
| 2004/0097850 | A1 | 5/2004 | Plante | |
| 2004/0133133 | A1 | 7/2004 | Dreimann | |
| 2004/0158177 | A1 | 8/2004 | Van Brunt et al. | |
| 2005/0150720 | A1 | 7/2005 | Tudor | |
| 2005/0234372 | A1 | 10/2005 | Hansen et al. | |
| 2005/0235988 | A1 | 10/2005 | Hansen | |
| 2006/0005306 | A1 | 1/2006 | Call | |
| 2006/0089575 | A1 | 4/2006 | DeVlieger | |
| 2008/0108914 | A1 | 5/2008 | Brouqueyre et al. | |
| 2008/0221489 | A1 | 9/2008 | Madsen | |
| 2008/0300515 | A1 | 12/2008 | Nozzarella et al. | |
| 2009/0069728 | A1 | 3/2009 | Hoffmann | |
| 2009/0221944 | A1 | 9/2009 | Hobson | |
| 2010/0113993 | A1* | 5/2010 | Davis | A61H 23/0218 601/108 |
| 2010/0242955 | A1 | 9/2010 | Hansen | |
| 2010/0249634 | A1 | 9/2010 | Hansen | |
| 2011/0125068 | A1 | 5/2011 | Hansen et al. | |
| 2012/0067322 | A1 | 3/2012 | Andersson | |
| 2012/0291798 | A1 | 11/2012 | Park | |
| 2013/0261518 | A1 | 10/2013 | Hansen et al. | |
| 2013/0331747 | A1 | 12/2013 | Helgeson et al. | |
| 2014/0276271 | A1 | 9/2014 | Stryker et al. | |

FOREIGN PATENT DOCUMENTS

| | | |
|---|---|---|
| GB | 2 068 737 A | 2/1981 |
| WO | 2011/094883 | 8/2011 |

OTHER PUBLICATIONS

AffloVest Instructions for Use and Owner's Manual, AffloVest.com; document created Jun. 24, 2013 (18 pages).

Clinical Study of the AffloVest, Mar. 2013 (6 pages).

(56) References Cited

OTHER PUBLICATIONS

Rubin, Bruce K.; Emerging Therapies for Cystic Fibrosis Lung Disease; Chest; 1999; vol. 115; pp. 1120-1126.
International Biophysics Corporation—"AffloVest Answering Needs: The Role of the AffloVest in the Respiratory Market" AffloVest White Paper.

* cited by examiner

WEARABLE THORAX PERCUSSION DEVICE

CROSS REFERENCE TO RELATED APPLICATIONS

This application is a continuation of U.S. application Ser. No. 13/930,586, filed Jun. 28, 2013, which is a continuation-in-part of U.S. application Ser. No. 13/538,716, filed Jun. 29, 2012, each of which is hereby incorporated by reference herein in its entirety.

FIELD OF THE INVENTION

The present invention relates to a wearable thorax percussion device.

BACKGROUND OF THE INVENTION

Cystic fibrosis (CF) is a hereditary chronic disease affecting human patients that causes the buildup of thick, sticky mucous in the lungs and other parts of the body. If left untreated, the mucous can clog air ways, and lead to complications such as tissue inflammation or infection, or other symptoms such as coughing, phlegm, and compromised cardio-respiratory performance.

One technique to manage CF is chest physiotherapy (CPT), which involves the manipulation of the patient's thorax to dislodge mucous buildup in the airways and encourage expectoration of the mucous. CPT may have to be performed in several sessions in a day, with each session lasting from between 10 to 45 minutes. CPT can be performed manually by therapists who use their hands to repeatedly percuss the patient's thorax. However, manually performed CPT can be physically and time demanding and should only be performed by a properly trained therapist. Alternatively, CPT can be performed using handheld or wearable mechanical devices. Wearable devices have the advantage over handheld devices of relieving the therapist or patient from having to manipulate the device during the treatment session.

Some wearable devices administer pulsating pneumatic pressure to the patient, U.S. Pat. No. 4,838,263 to Warwick et al, describes a vest bladder containing an air chamber and a pressurizing means to alternately pressurize and depressurize the air chamber to produce a pulsating compression on the patient's thorax, U.S. Pat. No. 6,036,662 to Van Brunt et al. describes a vest containing an air bladder that converts pulses of air into compressions to the patient's thorax. US Pat. Application No. 2005/0234372 to Hansen et al. describes a vest with an internal air chamber for receiving repeated pulses of air, which translate through the vest as pressure pulses against the patient's thorax. However, these devices rely on intimate contact between the vest and the patient's thorax and tend act over a relatively large area of the patient's thorax, with the result that they may constrict the patient's normal breathing motions.

Some wearable devices sonically transmit pressure waves to the patient generated by an acoustic transducer. U.S. Pat. No. 6,193,677 to Cady describes a vest incorporating a speaker to deliver low frequency pulsed audio signals to the patient, U.S. Pat. No. 6,193,677 to Plante describes a vest with a plurality of pockets or a harness-type arrangement to support an acoustic transducer to propagate acoustic waves via an acoustic coupling chamber to the patient. US Pat. Application No. 2008/0108914 to Brouqueyre et al, describes a vest with a vibration unit to transmit low frequency acoustic waves through a form-fitting material like a gel or fluid contained in the inner surface of the vest. However, transmission of pressure waves through a compressible medium may not be as efficacious as direct mechanical manipulation of the patient's thorax.

Some wearable devices administer mechanical impacts or vibrations to the patient. U.S. Pat. No. 3,310,050 to Goldfarb describes a vest-like garment or harness-type arrangement with a plurality of pockets to support a plurality of electromechanical vibrators to produce pulsating impacts that are communicated to the patient either by direct contact with the patient or indirectly through coupling constituted by the vest material and webbing belts. U.S. Pat. No. 5,235,967 to Arbisi et al, describes a vest-like garment with an internalized frame continuous throughout the garment, containing a plurality of movable electrically conductive elements that are actuated by a pulsed magnetic field produced by drive coils that are energized by a drive circuit. U.S. Pat. No. 5,261,394 to Mulligan et al. describes a percussive aid comprising arms that are reciprocally driven between a cocked position and a contact position by a drive mechanism, within a frame curved to fit the patient and adapted to be worn like a backpack, secured to the patient's thorax by shoulder and waist straps. US Pat. Appl. No. 2006/0089575 to DeVlieger describes a rigid element with pads clamped to the body, which transmit vibrations from an attached vibrator. The effectiveness of such devices depends, in part, on the ability to maintain contact at the interface between the device and the patient.

Accordingly, there remains a need for a wearable thorax percussion device that provides for effective, comfortable, convenient and consistent treatment of the patient.

SUMMARY OF THE INVENTION

Embodiments of the device provide a mechanical means for CPT without the labour of a trained therapist. The device may be embodied in a form that is light weight, and ergonomically adapted to the anatomy of the thoracic region.

In one aspect, the invention may comprise a wearable thorax percussion device, the device comprising: (a) at least one frame element comprising a flat, rigid layer; (b) at least one electromechanical actuator retained by the at least frame element and comprising a reciprocating member for causing percussive forces against the thorax, either directly or indirectly; and (c) an electronic controller and a power source operatively connected to the at least one actuator, for generating and modulating an electrical signal to energize the at least one actuator.

In one embodiment, the device may comprise a front frame element and a rear frame element, interconnected by a plurality of straps, at least one of which is elastic or adjustable, or elastic and adjustable. The front frame element may comprise two symmetrical halves disposed on opposite sides of a front fastener system. The rigid layer may be substantially rigid in a planar direction and flexible in a direction normal to the planar direction. The device may comprise a garment.

In one embodiment, each actuator may comprise an inner cap and an outer housing, enclosing an electromagnet and a permanent magnet, one of which reciprocates in response to the electrical signal.

In another aspect, the invention may comprise a wearable thorax percussion device comprising at least one electromechanical actuator, which comprises: (a) a magnet producing a first magnetic field; (b) an electromagnet energizable to produce a second magnetic field, wherein the first magnetic field and the second magnetic field interact to repel or attract the permanent magnet and the electromagnet; (c) a cap in driving engagement with either the permanent magnet or the electromagnet for percussing the thorax of a user; and (d) a controller for generating for producing an actuating electrical signal for actuating the at least one actuator.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention. The drawings are briefly described as follows.

DETAILED DESCRIPTION

The invention relates to a wearable thorax percussion device. When describing the present invention, all terms not defined herein have their common art-recognized meanings.

The term "thorax" as used herein means the region of the human body which lies between the head and the abdomen, which includes the thoracic cavity enclosing the lungs, trachea and bronchi or portions thereof.

In general terms, the invention comprises a wearable device comprising a front frame and a rear frame, each comprising a plurality of electromechanical actuators, and which are interconnected to form a wearable device. The frame members retain and position the actuators in desired locations adjacent a user's thorax. The elements of the device are intended to work in concert to provide a device that is wearable with relative comfort, while allowing the actuators to provide effective percussion to the thorax of a user.

Figure 1:
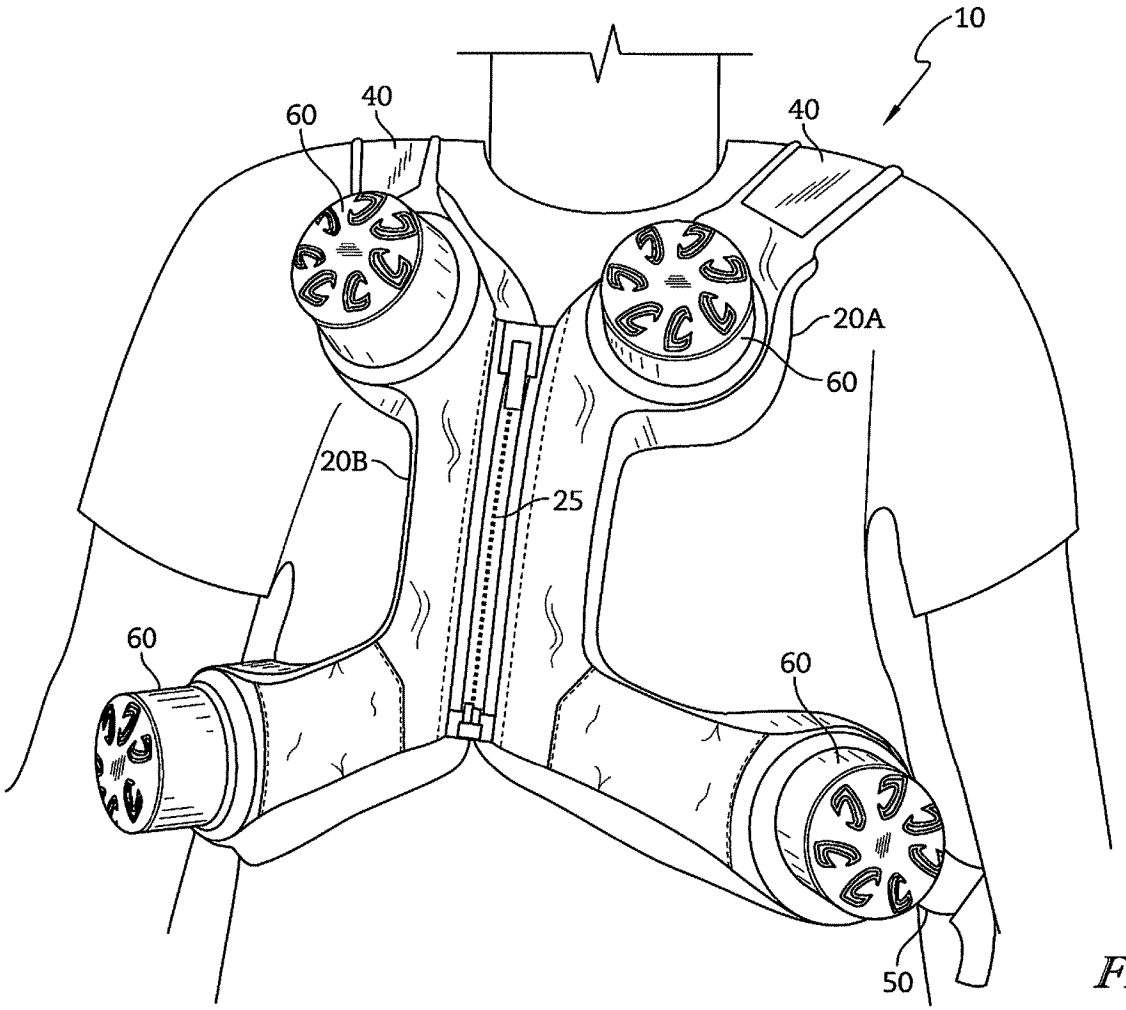
FIG. 1 is a front perspective view of one embodiment of the device of the present invention, worn by a user.

In one embodiment, the device (10) comprises a front frame member (20) and a rear frame member (30). The front frame member may be split into two symmetrical portions, which permits the device to be put on over the shoulders of the user and fastened together in the front with a zipper or the like, as is shown in FIG. 1. Alternatively, the front frame member may be unitary, and the device may then slipped on over the head of the user, or fastened at the side.

In one embodiment, the front frame (20) is connected to the rear frame (30) by a plurality of flexible straps comprising, in one embodiment, shoulder straps (40) and side straps (50). The straps may be elastic and/or adjustable, using well known buckles or connectors. Elastic and/or adjustable straps may accommodate patients with different sizes and shapes, or patients with mild to severe kephosis, which is common in CF patients. The side straps are preferably elastic so as to accommodate expansion and contraction of the thorax due to normal breathing, which is typically in the order of about 2 to 6 inches change in circumference.

The actuators (60) are powered elements which cause percussive strikes against the body of the user. In one embodiment, the actuators comprise electromechanical actuators which reciprocate in a linear fashion. In one embodiment, the front frame member (20) comprises four actuators (60), each positioned in one of four quadrants of the user's thoracic area, each quadrant created by a vertical midline and a horizontal midline through the thorax. The lower actuators are positioned slightly further away from the vertical midline, approximating the shape of a user's lungs. The rear frame member (30) also comprises four actuators, similarly positioned on the user's back thoracic area.

In one embodiment, the device comprises a front left frame element (20A), a front right frame element (2013) and a single rear frame element (30). This split front frame (20) accommodates a device or garment having a front central closure, such as a full length zipper (25). The frame elements may be substantially rigid or semi-rigid as they function to maintain the device shape and retain and position the actuators when in use. In one embodiment, the frame members are flat, planar members, oriented to lay flat against the user, such that they are substantially rigid in the planar direction. Accordingly, the frame members rigidly position the actuators. However, the frame members do allow some flexibility in a direction normal to the planar direction, which allows the device to closely conform to the shape of the user's thorax.

Each frame element may define openings within which the actuators (60) are positioned and retained. In one embodiment, each frame element may define multiple or elongated openings (not shown), which allows adjustable positioning of the actuators within the frame element.

In one embodiment, each front frame element (20A, 20B) retains four actuators (60A-D) to percuss the front region of the thorax to the right and left of the sternum. The rear rigid element (30) retains four actuators (60E-H) to percuss the user's back, symmetrically about the spine. The number of actuators (60) and their positioning can be strategically selected. In general, the position of the actuators (60) relative to the sternum and the spine should preferably not change significantly with patients ranging from the 5.sup.th percentile to the 95.sup.th percentile, and as such a single size of frame element (30) with adjustable placement of actuators can be used by a large portion of the patient demographic population.

Figure 2:
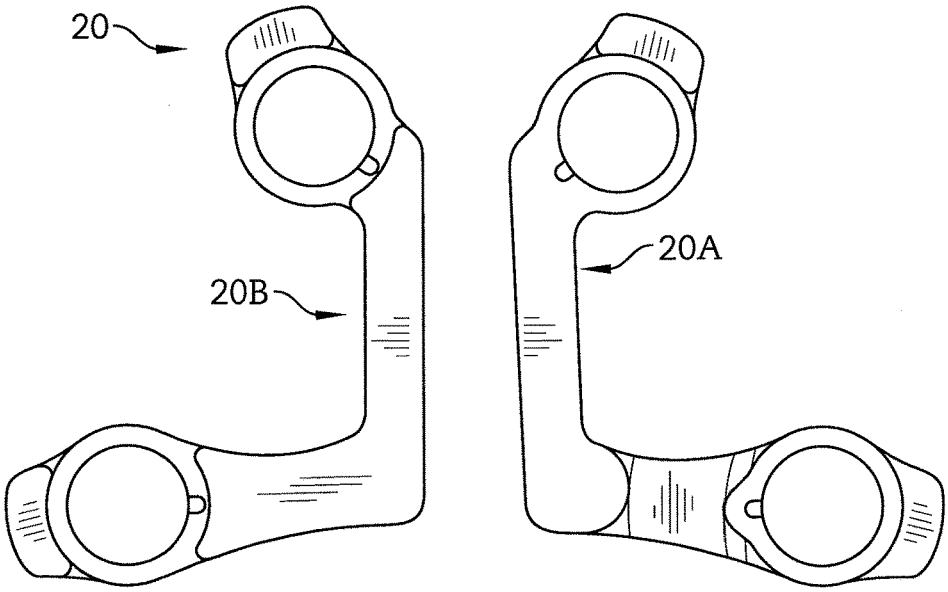
FIG. 2 is a view of the front frame elements of the embodiment of FIG. 1.
Figure 3:
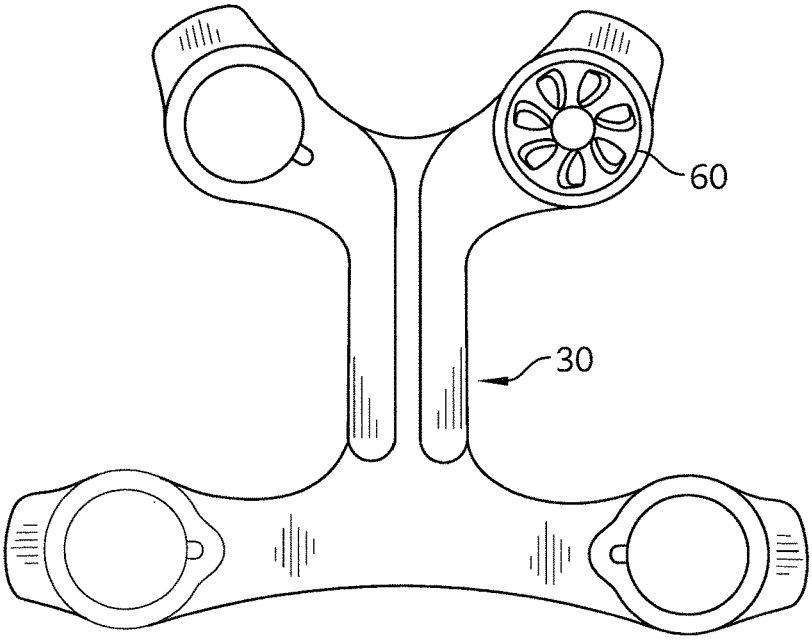
FIG. 3 is a view of the rear frame element of the embodiment of FIG. 1.
Figure 4:
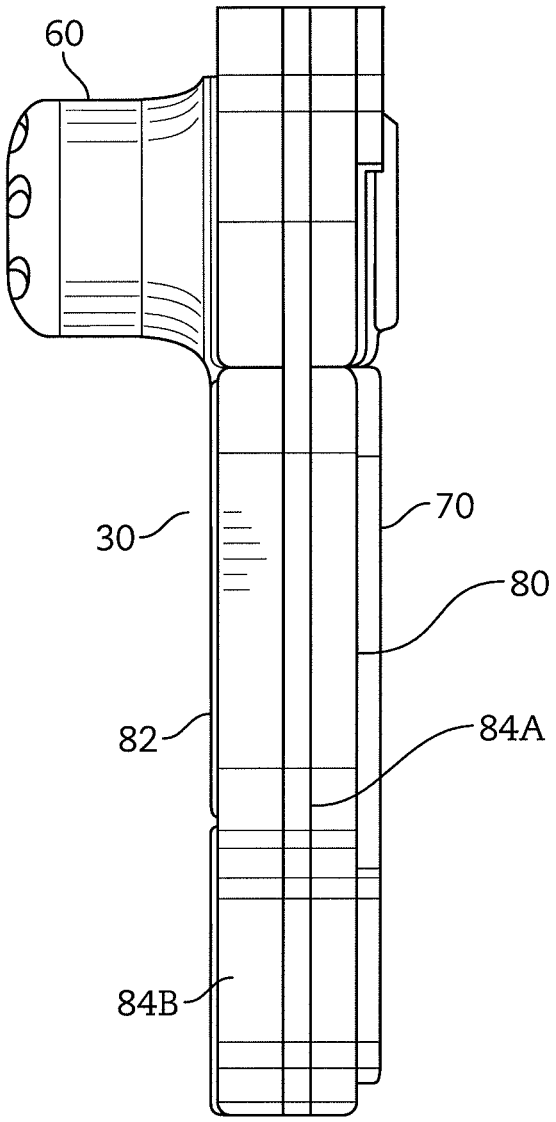
FIG. 4 is a side view of the rear frame element of FIG. 3.

As seen in FIG. 2, the front frame elements (20A, 20B) may have a curved shape to avoid resting on the patient's breasts, which might prevent the retained actuators (60) from positively contacting the thorax.

The frame elements (20, 30) may comprise a rigid layer, manufactured from sheet materials that are light weight, and have sufficient stiffness, impact resistance and durability to retain the actuators (60) with repeated use, such as metals or thermoset or thermoplastic materials. Suitable materials include aluminum or other metals, varieties of plastics include ABS (acrylonitrile-butadienestyrene), polystyrene, high impact polystyrene (HIPS), and KYDEX™ material, or composite materials such as fiberglass or carbon fiber.

Figure 5:
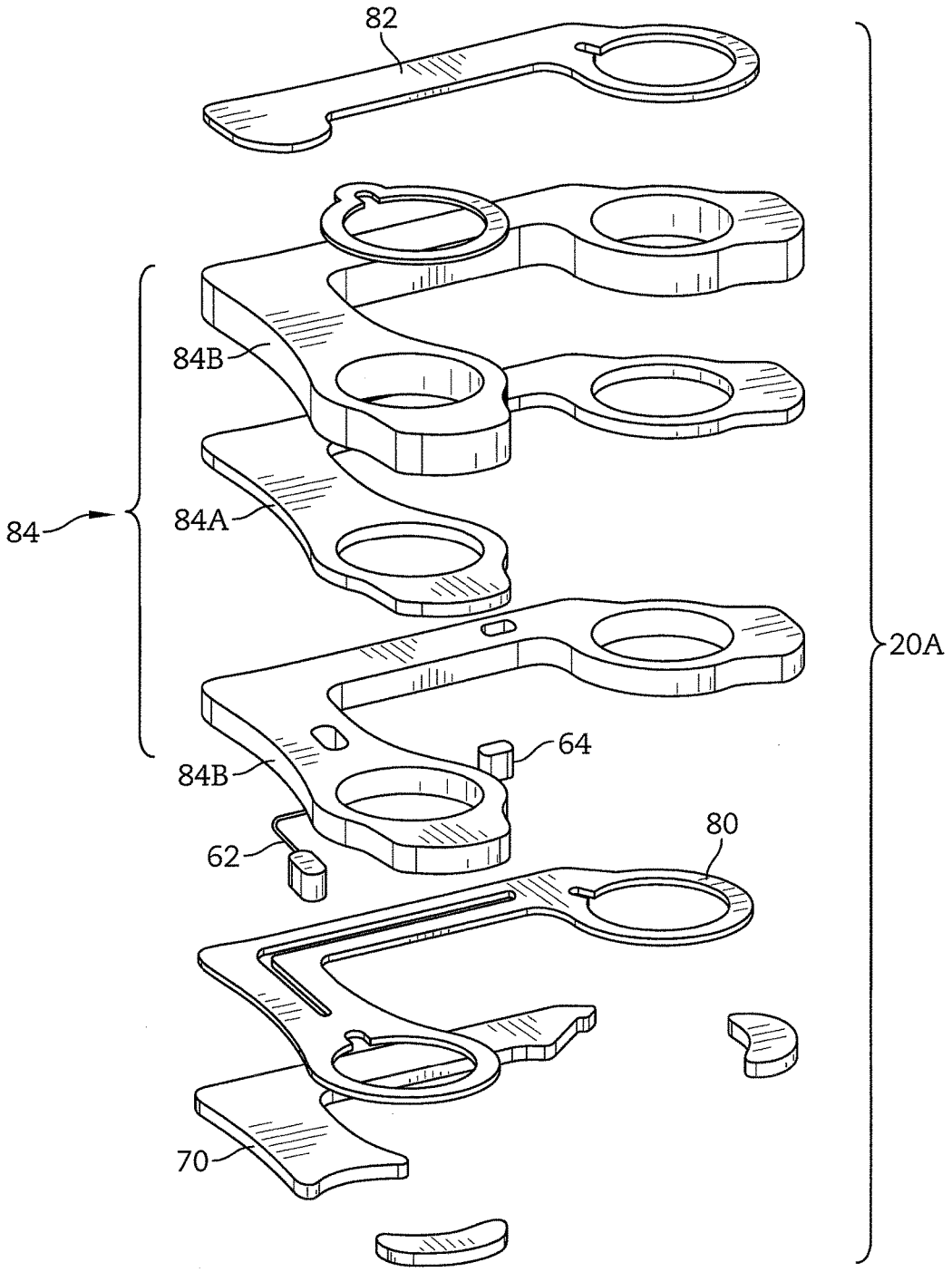
FIG. 5 is an exploded view of the left front frame element of FIG. 2.

The frame elements (20, 30) may be configured with cavities, fingers, apertures and other features to retain or permit access to the actuators (60), the controller and any wires or cables use to conduct power or control signals to the actuators. As shown in FIG. 5, wires (62) and connectors (64) are disposed in a cutout portion of the frame element.

In one embodiment, the frame elements are combined with at least one conformable layer (70) which is positioned on the side of the frame element facing the user's body. This layer provides some comfort for the user. The conformable layer may comprise an open-celled foam, which would also provide breathability and increased comfort.

In one embodiment, the frame elements comprise a multi-layer construction, with at least one rigid layer and at least one flexible layer. In one embodiment, the frame elements comprise a sandwich construction, with a flexible layer disposed between two rigid layers. As shown in FIG. 5, in one embodiment, the frame elements comprise an inner rigid plastic layer (80), an outer rigid plastic layer (82), and an intermediate foam layer (84). The intermediate foam layer (84) may itself be multi-layered, with a viscoelastic layer (84A) and a flexible foam layer (84B), which may comprise an open or closed cell foam comprising ethylene-vinyl acetate (EVA), ethylene propylene diene monomer (EPDM) or a polyurethane foam. Viscoelastic foams or low-resistance polyurethane foams, commonly known as memory foam, are dilatant materials, meaning their rigidity increases when subject to applied shear forces. Accordingly, when the actuators (60) are active, a viscoelastic foam layer (84A) may provide some increased rigidity to the device, but still allow some flexibility for a conformal fit to the user's body. FIG. 5 shows an exploded view of a left front frame element.

The multi-layered frame elements may be encased in a fabric sleeve, which preferably comprises a soft, flexible and breathable material.

The actuators require a power source, which may comprise rechargeable batteries, and an electronic controller for generating and modulating a signal for energizing the actuators. The power source and controller may be integrated into a module (not shown) connected to the device by wires. Alternatively, the module may be integrated into the device.

Figure 6:
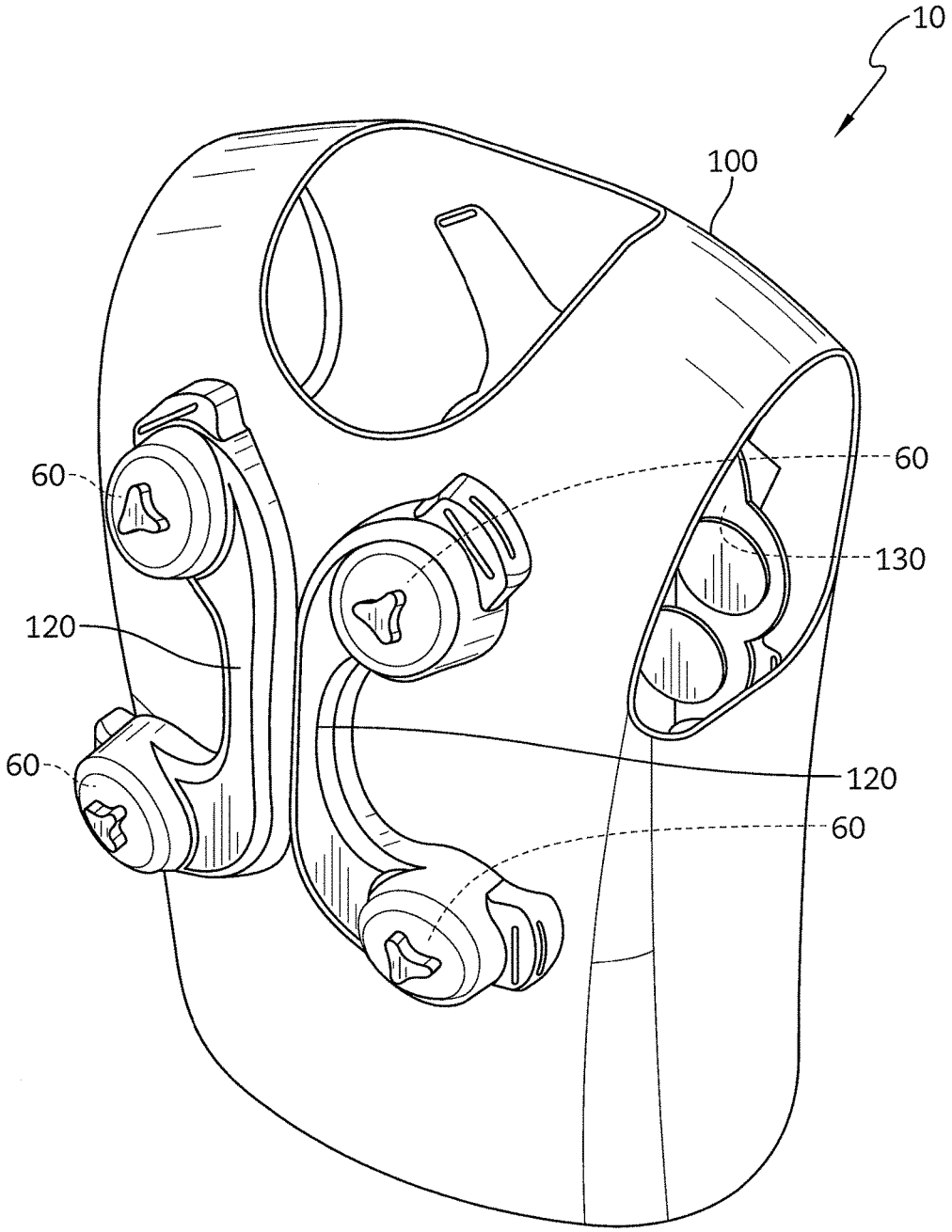
FIG. 6 is a perspective view of an alternative embodiment of the present invention.
Figure 7:
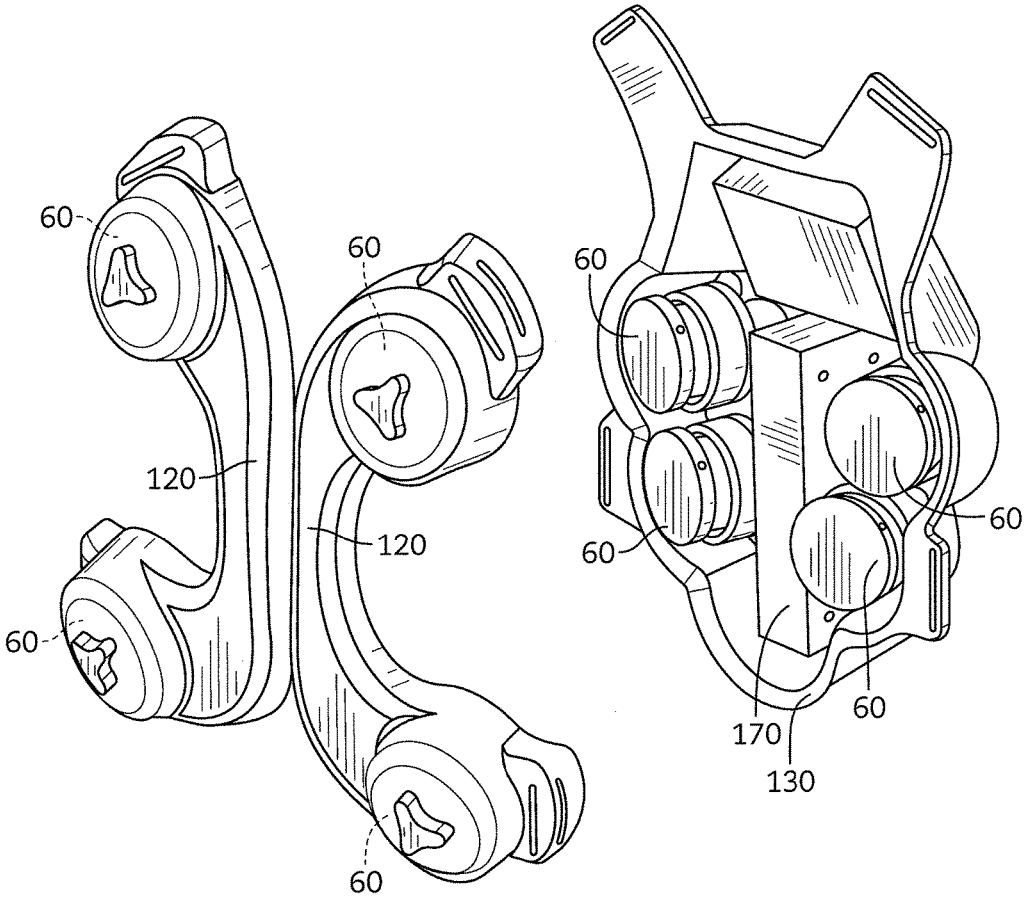
FIG. 7 is a perspective view of the front frame elements and rear frame element of FIG. 6.

In an alternative embodiment, shown in FIGS. 6 and 7, the device comprises a vest-like garment (100), comprising front and rear frame elements (120, 130), a plurality of electromechanical actuators (60), and an electronic controller (170). The frame elements may be interconnected by the garment itself and/or with straps which are separate from or integral to the garment.

The vest-like garment (100) may comprise a variety of fasteners and adjustments to facilitate fitting the garment to the thorax and positioning the frames (120, 130) on the user when the garment is worn. The front portion of the garment (100) may open and close with hook and loop fasteners, or other conventional fasteners such as zippers, clips or buttons, to permit the patient to don the garment (100). Additionally, or alternatively, the garment may be made of an elastic material to permit the user to slip the garment on, or to adjust to individual body shapes, or both.

The garment is preferably constructed of a light-weight, flexible and elastic material to accommodate the contours of the thorax. The garment may separate the actuators (60) from the user to protect the user from pinch points of moving components or electronic components associated with the actuators (60). Alternatively, the garment may define openings through which the actuators may contact the user.

Figure 8:
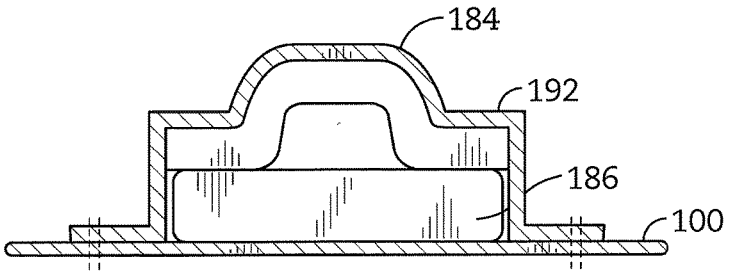
FIG. 8 is a cross sectional view of the construction of the garment and the frame element.
Figure 9:
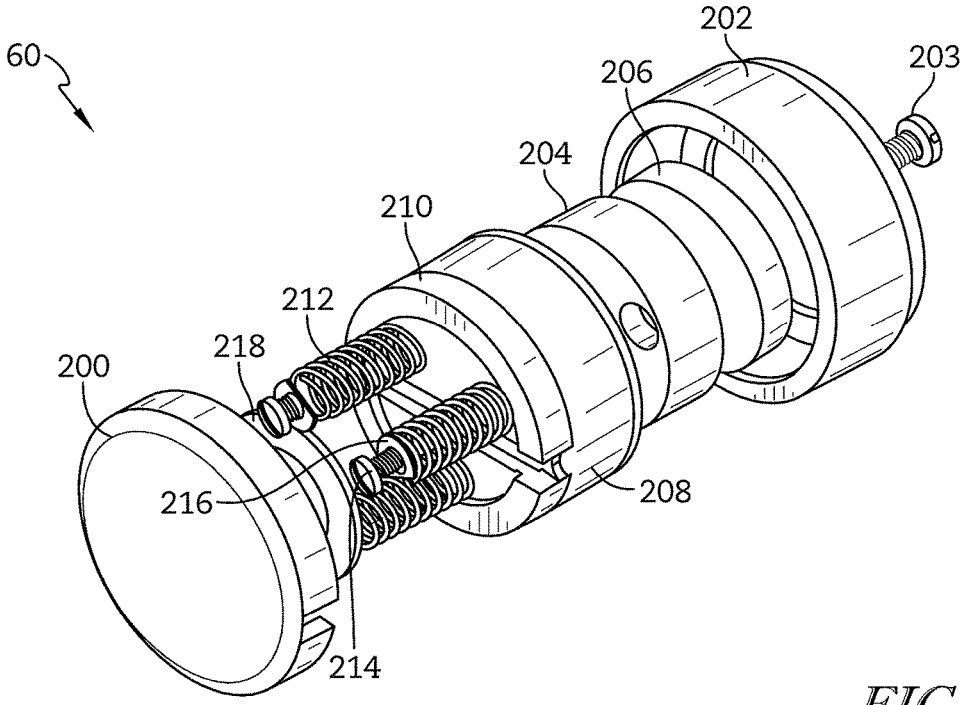
FIG. 9 is a perspective exploded view of one embodiment of an electromechanical actuator.
Figure 10:
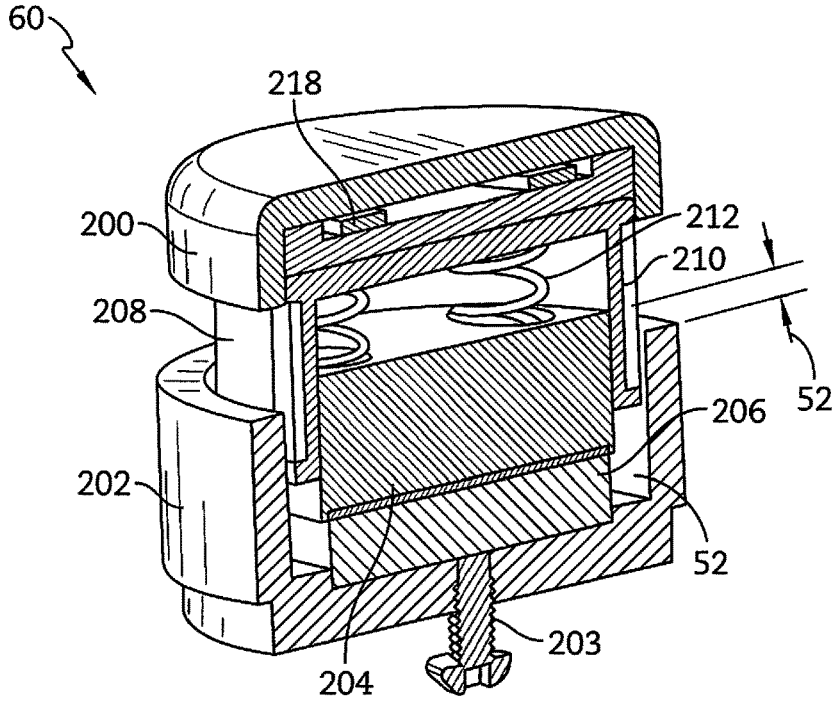
FIG. 10 is a perspective sectional view of the embodiment of FIG. 9.

In one alternative embodiment, as shown in FIG. 8, each frame element may comprise a rigid layer (184) which comprises a curved cross-sectional profile, thereby increasing its rigidity and creating a channel for passing cables or wires through the device. An intermediate foam layer (186) is disposed between the rigid layer (184) and the garment or base layer (100). A fabric sleeve (192) covers the rigid layer (184) and affixes them to the garment or base layer (100).

In one embodiment, the fabric sleeve (92, 192) provides an aesthetically and tactilely pleasing interface for the frame elements (20, 30). The fabric sleeves may also have design features to selectively expose parts of the frame elements or the controller (170) for access by the patient. The fabric sleeve (92, 192) may itself comprise thin foam/fabric combinations.

In one embodiment, the actuator (60) comprises a cap (200) at one end to provide an interface to percuss the thorax, and a housing (202) at the other end to attach to a frame element (20, 30). A screw (203) may be used to facilitate attachment. A permanent magnet (206) creates a magnetic field that permeates through the surrounding housing (202) and inner disc (204), which are made of non-permanent magnetic materials and separated by a magnetic gap (52). An electromagnet (208) is created by a coil wrapped around a bobbin (210). When an electric current is passed through the coil, it produces a magnetic field opposite in direction to the magnetic field created by the permanent magnet (206). The interaction of the magnetic fields repels the electromagnet away from the permanent magnet, thereby actuating the attached cap (200). Thus, the actuator may be oscillated, causing percussive strikes against the user's thorax when in use. The bobbin (210) and cap (200) may have channels through which the coil leads can exit the actuator (60) without a stress point. The bobbin (210) may be constructed of a wear and temperature resistant material such as PPS (polyphenylene sulphide), ULTEM™ polymer, or polysulfone thermoplastic polymers. The bobbin may also act as a bearing surface in the event that there are side loading forces. The coil may be constructed with multi-strand wires or wires covered by a silicone sheath. Wire gauges ranging between 22 g and 30 g are appropriate for this application. In one embodiment, the coil comprises 6 layers of 28 g wiring.

In one embodiment, the actuator (60) is compressible between the thorax and the frame element. Thus, the actuator (60) can be preloaded by pressing it against the thorax to better maintain positive contact between the cap (200) and the thorax. The actuator (60) is made compressible by springs (212) or other resilient compressible means. The springs (212) pass through apertures in the bobbin (210) and inner disc (204), connected at one end to the cap (200) using a washer (218) and bear at the other end on the magnet (206). An assembly of screws (214) and D-washers (216) retains the springs (212) to the inner disc (204).

Figure 11:
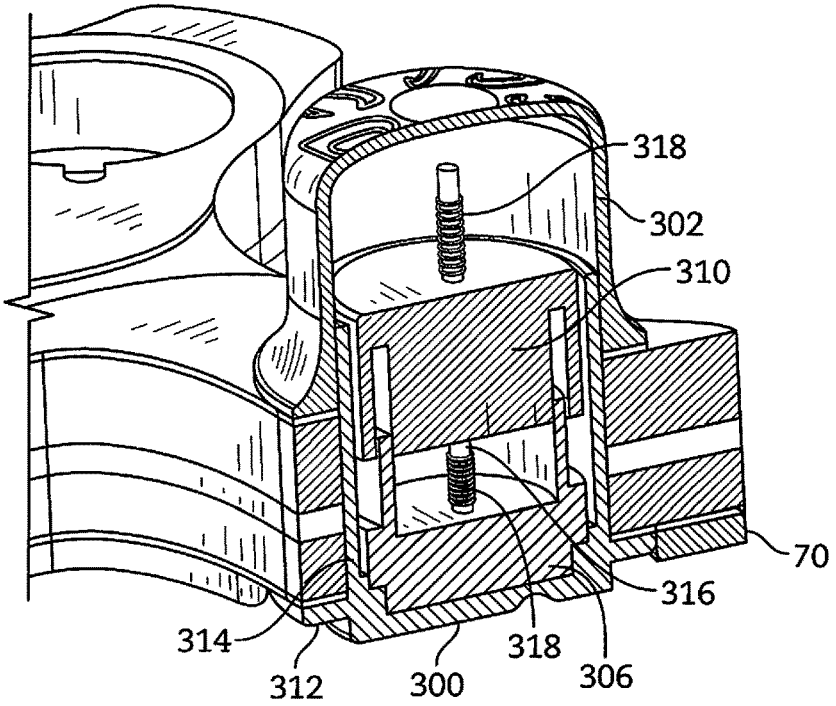
FIG. 11 is a perspective sectional view of an alternative embodiment of an electromechanical actuator.

In another embodiment, as shown in FIG. 11, the cap (300) comprises a flange (312) and cylindrical portion (314) which fits through circular openings in the frame element (20). A bell-shaped housing (302) is attached to the cylindrical portion, and to the opposing side of the frame element (20). The permanent magnet (306) is disposed at one end, which an electromagnet (310) reciprocates on a guide shaft (316). Small springs (318) on either side of the electromagnet (310) may be provided to regulate movement of the electromagnet (310) and to prevent "clapping" at the far, ends of the range of motion. In this embodiment, all moving parts are contained within the cap and housing, and the percussive force is transmitted to the user through the cap (300). Thus, the cap primarily stays in contact with the user as the actuator is creating percussive forces. The cap is preferably installed flush with the conformable layer (70), as may be seen in FIG. 11.

Figure 12:
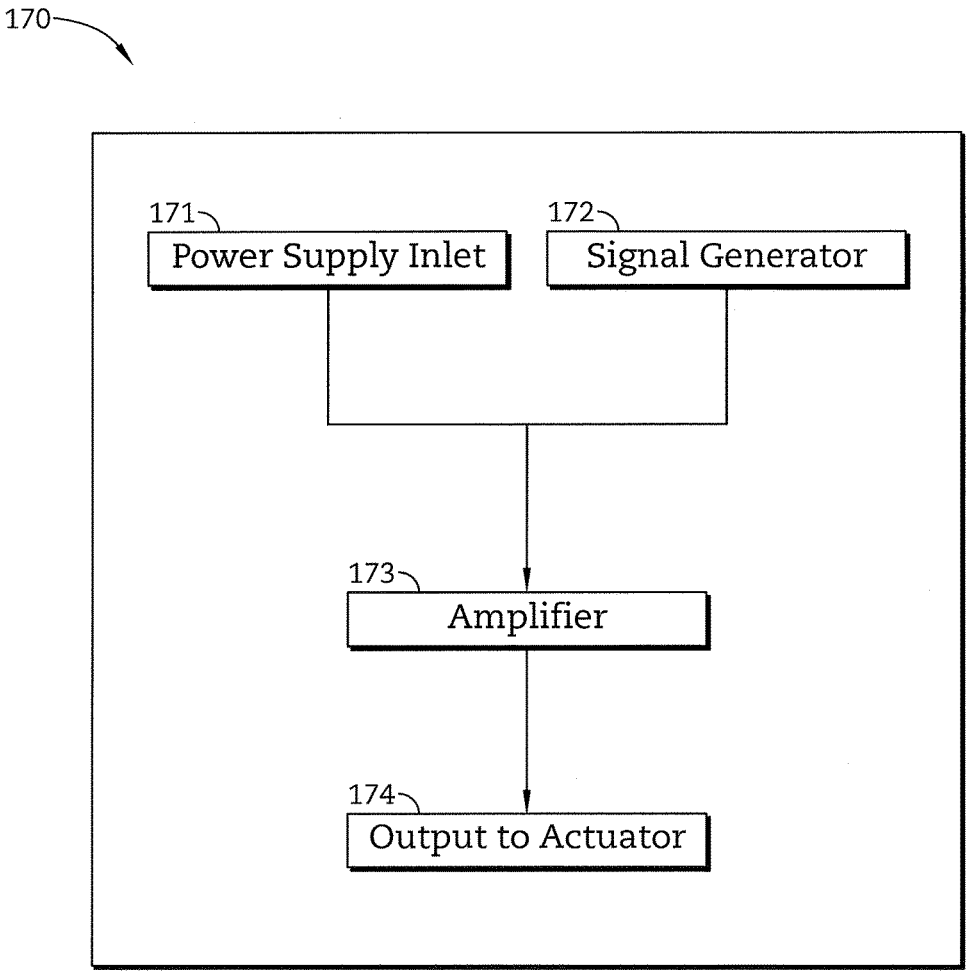
FIG. 12 is a schematic block diagram of on embodiment of an electronic controller.

One embodiment of the electronic controller (170), as shown in FIG. 12, comprises an operably connected power supply inlet (171), a signal generator (172), an amplifier (173) and an output to actuator (174). The power supply inlet (171) is adapted to receive electrical power from any suitable source, such as a battery, AC-DC power, or a combination of the foregoing. The signal generator (172) may generate any suitable signal, such as a sinusoidal, triangular and square electrical wave signals, with frequencies in the order of 10 to 25 Hz. In one embodiment, the frequency of the actuators may be below the acoustic range, for example, below about 20 Hz.

In order to protect against current inrush from overwhelming the power supply and associated traces, the controller (170) may introduce a short delay, preferably in the order of about 0.01 to 0.5 millisecond, between the turn-on time of each actuator (60) or phase the actuators (60) with respect to each other. The amplifier (173) utilizes the signal from the signal generator (172) and power received by the power supply inlet (171) to supply a nominal current, which may be about 0.7 A RMS, to the actuator (60). The amplifier (173) may include circuitry to maintain a constant percussion force despite variations in the power supply, such as an H-bridge with each channel having a dedicated chip to compensate each channel, or to have the ability to attenuate or disable a particular channel, relative to the other channels.

In one embodiment, the controller (170) may include a variety of controls such as an on/off control to start or stop a prescribed treatment cycle, a pause control to temporarily stop the treatment cycle to allow for mucous clearance, a frequency control to adjust the rate at which the actuators (60) deliver percussive force, an amplitude control to adjust the amount of current applied to the actuators (60) in a given period, and a timer for the on/off functionality to ensure that the treatment cycle is completed while accounting for any pauses.

The frame elements (20, 30), actuators (60) and the controller (170) may be tuned to produce desired force specifications. In one embodiment, the actuators (60) have a force constant of approximately 1 to 30 lbs per Ampere and apply percussive forces to the thorax of within a reasonable range of 1 to 10 lbs, which is similar to the magnitude of forces applied by a therapist administering manual CPT. In one embodiment, the force imparted by each strike of the actuator may be about 5 lbs.

The invention claimed is:

1. A wearable thorax percussion device, the device comprising:

a fabric;

at least one frame element comprising a flat, rigid layer coupled to the fabric, the at least one frame element having at least some flexibility to conform to a shape of a user's thorax, the fabric and at least one frame element forming a garment to be worn on the user's body;

a plurality of electromechanical actuators each having a dimension in a direction configured to be normal to the user's thorax greater than a combined thickness of the fabric and the at least one frame element and each retained by the at least one frame element, each electromechanical actuator comprising a reciprocating member for causing percussive forces against the thorax, either directly or indirectly; and an electronic controller and a power source coupled to the garment and operatively connected to the plurality of electromechanical actuators, for generating and modulating an electrical signal to energize the plurality of electromechanical actuators.

2. The device of claim 1 wherein the device comprises a front frame element and a rear frame element, interconnected by a plurality of straps, at least one of which is elastic or adjustable, or elastic and adjustable.

3. The device of claim 2 wherein the front frame element comprises two symmetrical halves disposed on opposite sides of a front fastener system.

4. The device of claim 2 wherein each frame element retains two or more electromechanical actuators.

5. The device of claim 4 wherein the plurality of electromechanical actuators comprises eight electromechanical actuators comprising four front electromechanical actuators and four rear electromechanical actuators, each positioned in a quadrant created by a vertical midline and a horizontal midline through the thorax.

6. The device of claim 1 wherein the electronic controller is adapted to drive each electromechanical actuator at a frequency below about 20 Hz.

7. The device of claim 1 wherein each electromechanical actuator applies a force of between about 1 pound and about 10 pounds with each percussive strike.

8. The device of claim 1 wherein each frame element further comprises a flexible layer.

9. The device of claim 8 wherein each frame element comprises an inner rigid layer and an outer rigid layer, and a foam layer disposed therebetween.

10. The device of claim 9 wherein the foam layer comprises a viscoelastic foam layer.

11. The device of claim 1 wherein the garment comprises a vest.

12. The device of claim 1 wherein each electromechanical actuator comprises an inner cap and an outer housing, enclosing an electromagnet and a permanent magnet, one of the electromagnet and the permanent magnet of which is configured to reciprocate in response to the electrical signal.

13. The device of claim 1 wherein each electromechanical actuator comprises an inner cap and outer housing, enclosing an electromagnet and a permanent magnet, and wherein the electromagnet is configured to reciprocate on a guide shaft and comprises rebound control elements at both ends of the guide shaft.

14. The device of claim 1 wherein the rigid layer is substantially rigid in a planar direction and flexible in a direction normal to the planar direction.

15. The device of claim 1 wherein each frame member comprises an inner conformable layer.

16. The device of claim 15 wherein at least one electromechanical actuator of the plurality of electromechanical actuators is mounted flush with the inner conformable layer.

17. The device of claim 1, wherein the plurality of electromechanical actuators are each oriented in substantially perpendicular relation with the at least one frame element.

18. A wearable thorax percussion device, the device comprising:

a fabric;

at least one frame element comprising a flat, rigid layer coupled to the fabric, the fabric and at least one frame element forming a garment to be worn on the user's body;

a plurality of electromechanical actuators each having a dimension in a direction configured to be normal to the user's thorax greater than a combined thickness of the fabric and the at least one frame element, each electromechanical actuator retained by the at least one frame element, each electromechanical actuator comprising a reciprocating member for causing percussive forces against the thorax, either directly or indirectly; and an electronic controller and a power source coupled to the garment and operatively connected to the plurality of electromechanical actuators, for generating and modulating an electrical signal to energize each electromechanical actuator.

* * * * *